US012305508B2

(12) United States Patent
Baruah et al.

(10) Patent No.: US 12,305,508 B2
(45) Date of Patent: May 20, 2025

(54) ADVANCED FLOW RATE MEASUREMENT USING CHEMICAL PROSPECTOR OF OIL AND GAS PRODUCERS

(71) Applicant: SAUDI ARABIAN OIL COMPANY, Dhahran (SA)

(72) Inventors: Keshabananda Baruah, Abqaiq (SA); Ahmad M. Almousa, Mubarraz (SA); Hisham I. Al-Shuwaikhat, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 339 days.

(21) Appl. No.: 18/045,675

(22) Filed: Oct. 11, 2022

(65) Prior Publication Data

US 2024/0117739 A1 Apr. 11, 2024

(51) Int. Cl.
*E21B 49/08* (2006.01)

(52) U.S. Cl.
CPC ..... *E21B 49/0875* (2020.05)

(58) Field of Classification Search
None
See application file for complete search history.

(56) References Cited

U.S. PATENT DOCUMENTS

| | | | | |
|---|---|---|---|---|
| 7,860,669 | B2 | 12/2010 | Najim Al-Khamis | |
| 8,256,283 | B2 | 9/2012 | Terabayashi et al. | |
| 2002/0104328 | A1* | 8/2002 | DiFoggio | E21B 49/08 62/476 |
| 2003/0085039 | A1* | 5/2003 | DiFoggio | E21B 36/003 166/302 |
| 2017/0045490 | A1* | 2/2017 | Irani | E21B 49/08 |
| 2018/0038223 | A1* | 2/2018 | Nyhavn | E21B 47/11 |
| 2018/0275114 | A1* | 9/2018 | Kosynkin | G01N 30/7206 |
| 2018/0335374 | A1 | 11/2018 | Kanj et al. | |

FOREIGN PATENT DOCUMENTS

| | | | |
|---|---|---|---|
| CN | 110637147 | A | 12/2019 |
| RU | 2005102268 | A | 7/2006 |

OTHER PUBLICATIONS

Rose, Marlee, "Headers and Injecting Chemicals in Oil and Gas Production", Medium.com, May 1, 2017, URL: <https://medium.com/@marleerosegreasebook/headers-and-injecting-chemicals-in-oil-and-gas-production-2802a7ede0b5> (8 pages).

* cited by examiner

*Primary Examiner* — Patrick Assouad
*Assistant Examiner* — Mark A Shabman
(74) *Attorney, Agent, or Firm* — Osha Bergman Watanabe & Burton LLP

(57) ABSTRACT

A system for identifying and quantifying a fluid in a gas-oil separation plant conduit includes a first wellhead and a second wellhead, a first flowline, a first prospector spool apparatus and a second prospector spool apparatus, a header, and a collection point. The first and the second prospector spool apparatus each include a porous layer with a prospector molecule. The prospector molecule has chemical affinity for oil, gas, or water, and is configured to diffuse into fluid flow. A method includes providing a system, producing a first fluid from a first well and a second fluid from a second well, flowing the first fluid through the first prospector spool apparatus and the second fluid through the second prospector spool apparatus, allowing the first fluid and the second fluid to commingle, collecting a sample of and analyzing the commingled fluid to provide a quantitative and qualitative analysis.

17 Claims, 3 Drawing Sheets

ADVANCED FLOW RATE MEASUREMENT USING CHEMICAL PROSPECTOR OF OIL AND GAS PRODUCERS

BACKGROUND

Each day, pipelines transport and distribute diverse substances. These substances may include drinking water, consumable beverages, oil and gas products, chemicals, and alkalines. Fluids that flow through pipelines often display completely different properties. Consequently, there are different principles for measuring different properties of fluids.

In the oil and gas industry, various well testing systems acquire data from a well. A well test provides information about the state of the well that is being tested. The well test may include a flow meter system that monitors a flow rate, or a pressure meter system that monitors a pressure. These well tests may identify the reservoir's capacity to produce hydrocarbons such as oil, natural gas, and condensate.

One of the most common oil and gas well testing systems is a high pressure test trap mounted inside a gas-oil separation plant. In a gas-oil separation plant, the crude enters from a flowline (or trunkline) through a manifold. From the manifold, the crude may pass to a high pressure test trap or a high pressure production trap.

Many of these high pressure test trap systems have a Coriolis flow meter. When gas is separated from liquid in a test trap within a gas-oil separation plant, a flow meter measures mass flow including oil and water. From this mass flow measurement, along with oil and water density measurements, oil and water flow rates can be calculated. Coriolis flow measuring technology can measure mass flow, volume flow, density, temperature, and viscosity simultaneously.

Other conventional well testing systems may include use of a phase separator, a multi-phase flow meter, a production logging tool, and a water cut monitor, to name a few.

A flowline in a gas-oil separation plant may also have conventional instruments such as a flowmeter, a temperature sensor, a pressure sensor, a gas analyzer, a densitometer, and others.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, one or more embodiments disclosed herein relate to a system for identifying and quantifying a fluid in a gas-oil separation plant conduit. The system may include a first wellhead and a second wellhead; a first flowline coupled to and downstream of the first wellhead and a second flowline coupled to and downstream of the second wellhead; and a first prospector spool apparatus coupled to the first flowline and downstream of the first wellhead and a second prospector spool apparatus coupled to the second flowline and downstream of the second wellhead. The first prospector spool apparatus and the second prospector spool apparatus may include a housing including an inlet end and an outlet end; an inlet coupled to the housing and positioned at the inlet end; an outlet coupled to the housing and positioned at the outlet end; and a porous layer comprising a polymer media and a prospector molecule embedded therein, the porous layer being positioned within the housing between the inlet end and the outlet end, an inner surface of the porous layer defining a flow channel therethrough configured to allow fluid flow. The prospector molecule may have a chemical affinity for fluid selected from the group consisting of oil, gas, or water, and is configured to diffuse into the fluid flow. The prospector molecule of the first prospector apparatus may be different than the prospector molecule of the second prospector apparatus. The system may include a header coupled to and downstream of the first flowline and the second flowline may be configured to receive and commingle fluid from each of the first and second prospector spool apparatus outlets. The system may include a collection point downstream of the header configured to collect a sample of the commingled fluid.

In another aspect, one or more embodiments disclosed herein relate to a method for identifying and quantifying a fluid in a gas-oil separation plant conduit. The method may include providing a system. The system may include a first wellhead and a second wellhead; a first flowline coupled to and downstream of the first wellhead and a second flowline coupled to and downstream of the second wellhead; and a first prospector spool apparatus coupled to the first flowline and downstream of the first wellhead and a second prospector spool apparatus coupled to the second flowline and downstream of the second wellhead. The first prospector spool apparatus and the second prospector spool apparatus may include a housing including an inlet end and an outlet end; an inlet coupled to the housing and positioned at the inlet end; an outlet coupled to the housing and positioned at the outlet end; a porous layer comprising a polymer media and a prospector molecule embedded therein, the porous layer being positioned within the housing between the inlet end and the outlet end, an inner surface of the porous layer defining a flow channel therethrough configured to allow fluid flow. The prospector molecule may have a chemical affinity for fluid selected from the group consisting of oil, gas, or water, and is configured to diffuse into the fluid flow. The prospector molecule of the first prospector apparatus may be different than the prospector molecule of the second prospector apparatus. The system may include a header coupled to and downstream of the first flowline and the second flowline configured to receive and commingle fluid from each of the first and second prospector spool apparatus outlets. The system may include a collection point downstream of the header configured to collect a sample of a commingled fluid. The method may include producing a first fluid from a first well coupled to the first wellhead and a second fluid from a second well coupled to the second wellhead. The method may include flowing the first fluid through the first prospector spool apparatus and the second fluid through the second prospector spool apparatus. The method may include allowing the first fluid and the second fluid to commingle to produce the commingled fluid. The method may include collecting a sample of the commingled fluid at a collection point. The method may include analyzing the commingled fluid to provide a quantitative and qualitative analysis of the first fluid and the second fluid based on the sampled commingled fluid.

Other aspects and advantages of the claimed subject matter will be apparent from the following description and the appended claims.

DETAILED DESCRIPTION

In one aspect, embodiments disclosed herein relate to systems and processes for characterizing flow from a well. Embodiments disclosed herein relate generally to flow rate measurements of oil and gas producing wells. Even more specifically, embodiments herein relate to flow rate measurement of oil and gas producing wells using a chemical prospector system.

Chemical prospector systems according to embodiments herein are a system that may be used to deliver prospector molecules to produced fluids. For example, a chemical prospector system may be placed in a production flowline between a wellhead and a downstream vessel, such as a feed surge vessel of a gas oil separation plant receiving fluids from one or multiple wells for processing within the gas oil separation plant. Once delivered to the produced fluids, the prospector molecules may allow for measurement and quantification of flow of produced fluids from a well, even when the produced fluids are mixed with other produced fluids. Further, through use of unique prospector molecules associated with different wells, systems according to embodiments herein may provide both quantitative and qualitative rate measurements for the multiple wells, where a single sample that is collected can give individual rate production of each well in a network of wells feeding produced fluids to the gas oil separation plant.

Chemical prospector systems according to embodiments herein may include a prospector spool apparatus for delivering a prospector molecule to the produced fluids. A prospector spool apparatus includes a porous layer inside of a housing, with a prospector molecule embedded in the porous layer. The prospector molecule is a chemical that has chemical affinity for a specific type of fluid like oil, water, or gas. When a produced fluid passes through the prospector spool apparatus, the prospector molecule may be released from the porous layer and carried downstream with the produced fluids.

When multiple wells, flowlines, and prospector spool apparatus are included in a system, each well may be provided a prospector spool apparatus having a unique prospector molecule. The individual flows from the wells will each contain a unique prospector molecule (or combination of prospector molecules), allowing a single measurement to provide both quantitative and qualitative rate measurements of production from the multiple wells. Thus, systems and methods according to one or more embodiments herein may be used with a multiplicity of wells connected to a network of flowlines (and trunklines) feeding to a single gas oil separation plant.

Figure 1:
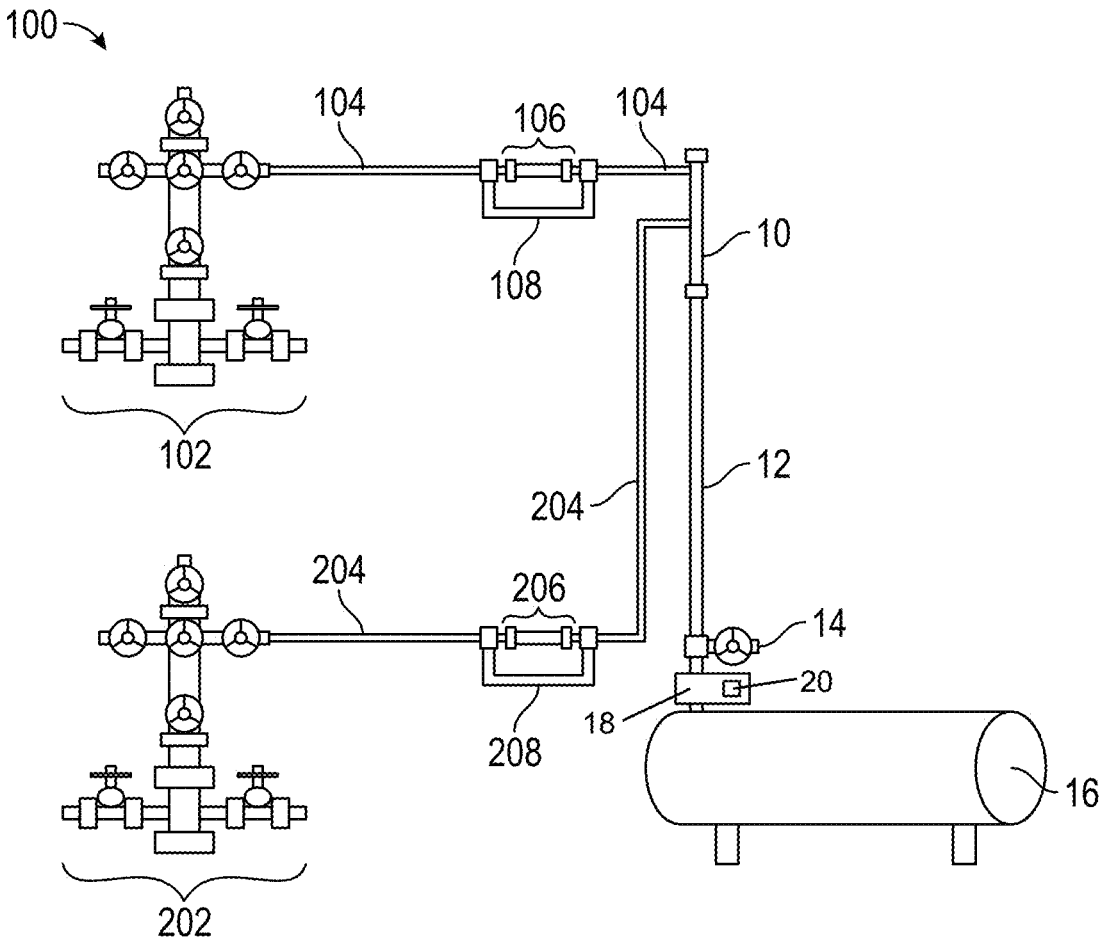
FIG. 1 shows a simplified process flow diagram of a system according to one or more embodiments of the present disclosure.

In one or more embodiments, the system may run from a well to a gas-oil separation plant. FIG. 1 depicts one or more embodiments of a system 100 for identifying and quantifying a fluid in a gas-oil separation plant conduit. The system includes a first wellhead 102 and a first flowline 104 coupled to and downstream of the wellhead. The system includes a second wellhead 202 and a second flowline 204 coupled to and downstream of the wellhead. The system includes a first prospector spool apparatus 106 coupled to the first flowline downstream of the first wellhead. The system includes a second prospector spool apparatus 206 coupled to the second flowline downstream of the second wellhead. While illustrated and described with respect to two wells, embodiments herein may be used with any number of wells, such as 3, 4, 5, 10, 15 or more.

The system may include a header 10 coupled to and downstream of the first flowline and the second flowline. The header conveys a fluid from the flowlines to the gas-oil separation plant. The fluid may include but is not limited to a commingled fluid, which is a blend of fluids from the multiple wells (first wellhead 102, second wellhead 202, etc.). The system may include a trunkline 12 that is downstream of the first flowline and the second flowline. In FIG. 1, the trunkline is downstream of the header. The trunkline may have a collection point 14 configured to collect a sample of the fluid (the collection point is disposed on the trunkline). The system may also include a vessel 16 downstream of the flowlines, the header, the trunkline, the collection point, or a combination thereof, such as a feed surge vessel of a gas oil separation plant (not illustrated).

The system may include a first bypass 108 coupled to the first flowline configured to pass fluid around the first prospector spool apparatus and to block fluid from entering the first prospector spool apparatus. The system may include a second bypass 208 coupled to the first flowline configured to pass fluid around the second prospector spool apparatus and to block fluid from entering the second prospector spool apparatus. Suitable valving (not illustrated) may be provided for isolation of the prospector spool apparatus (first prospector spool apparatus 106, second prospector spool apparatus 206), such as for maintenance or replacement of the prospector spool apparatus while continuing flow from the well to the gas oil separation plant, as will be described further below.

Figure 2:
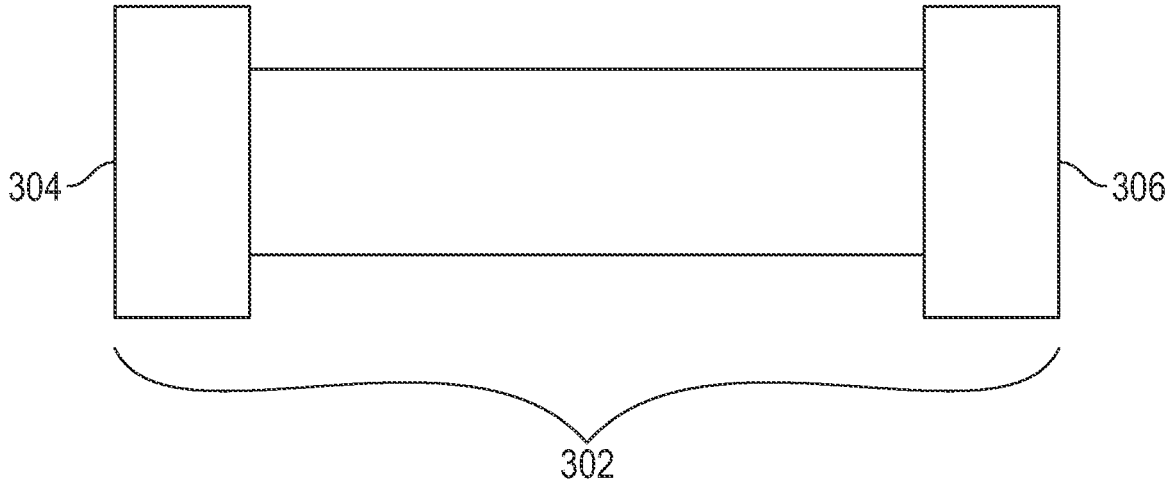
FIG. 2 shows a side view of a prospector spool apparatus, according to one or more embodiments of the present disclosure.

FIG. 2 depicts a side view a prospector spool apparatus. The prospector spool apparatus includes a housing 302 including an inlet end and an outlet end. An inlet 304 is coupled to the housing and positioned at the inlet end of the prospector spool apparatus. An outlet 306 is coupled to the housing and positioned at the outlet end of the prospector spool apparatus.

Figure 3:
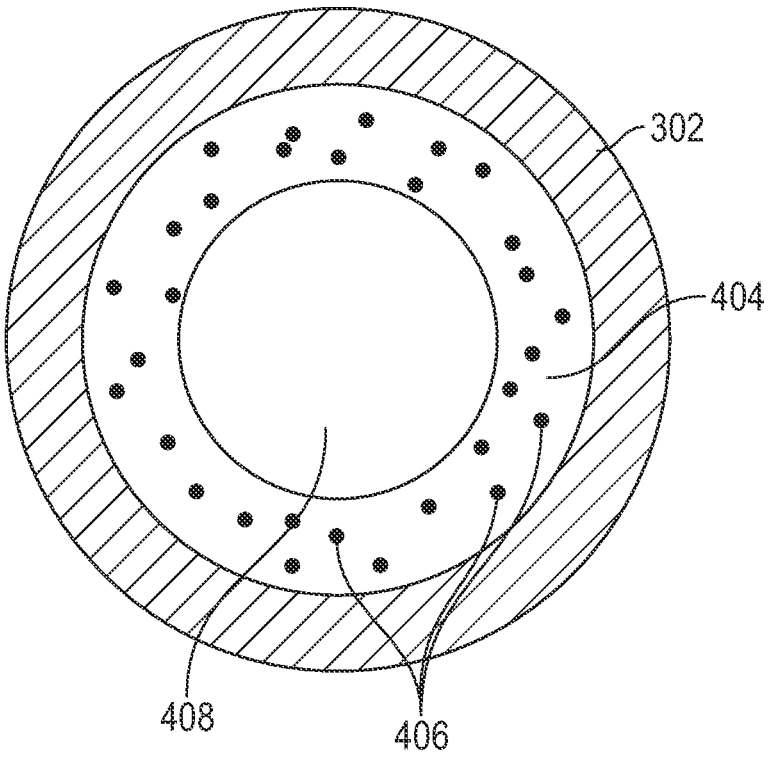
FIG. 3 shows a sectional view (front perspective) of the prospector spool apparatus, according to one or more embodiments.

FIG. 3 depicts a sectional view (front perspective) of a prospector spool apparatus, cross-sectioned at the housing between the inlet and the outlet. A prospector spool apparatus houses a prospector molecule that may be released into fluid that flows through the apparatus and system. A prospector molecule has chemical affinity for a particular type of fluid and is released from its fixed position in the prospector spool apparatus when the corresponding fluid type flows through the apparatus. Thus, the prospector molecule, apparatus, and system acts as a prospector, searching and allowing identification of fluids that flow from a well. The prospector spool apparatus may have a cylindrical shape (circular cross-section), but is not limited to a cylindrical shape, and other embodiments may be square, rectangular, prismatic, or another suitable shape as may be used for flow conduits.

In one or more embodiments, the prospector spool apparatus has a porous layer 404 comprising a polymer media. The polymer media may include, but is not limited to benzoxazine, polyepoxides, and combinations thereof. The porous layer may include carbon steel and/or stainless steel. As a non-limiting example, perforated channels may be positioned between the inner surface of the housing and the porous layer, connected to the porous layer, or within the porous layer. These perforated channels (not shown in the figures) may be made of steel or other suitable material. The perforated channels may be positioned longitudinally in the housing (from inlet end to outlet end) such that materials that flow through the perforated channels are evenly distributed through the porous layer. In one or more embodiments, a prospector molecule 406 is embedded in the porous layer 404. A prospector molecule is a uniquely identifiable molecule, for example, when compared to a different prospector molecule or another compound as may be expected to be transported through the prospector spool apparatus. The prospector molecule also has specific affinity to oil, water, or gas. Suitable examples of a prospector molecule include, but are not limited to fluorinated benzoic acid, perfluorinated hydrocarbons, sulfur hexafluoride (SF6), and combinations thereof. Embedding the prospector molecule in the porous layer may occur by pumping the prospector molecule through the perforated channels to evenly distribute the prospector molecules therein.

The porous layer is positioned within the housing of a prospector spool apparatus between the inlet end and the outlet end, configured to allow fluid flow. The porous layer is positioned along the inner surface of the housing. The porous layer advantageously withstands temperature, flow rate, and pressure regularly observed in a flowline while remaining intact. Materials that make up the housing include, but are not limited to carbon steel, stainless steel, aluminum, polyvinyl chloride, polyethylene, nickel, chromium, combinations thereof, and other various materials that may be used for flow conduits. In one or more embodiments, the prospector spool apparatus includes a flow channel 408 positioned along the central longitudinal axis of the housing defining an inner surface of the porous layer. The flow channel is configured to allow fluid flow from the inlet to the outlet while allowing the fluid to interact with and extract the prospector molecule 406 from the porous layer 404.

As shown in FIG. 1, a first prospector spool apparatus and a second prospector spool apparatus are included. Other suitable locations intermediate the well and includes the header may also be used. When a system includes three flowlines, there may be a first, a second, and a third prospector spool apparatus on the first, second, and third flowline, respectively.

In general, there are at least two prospector spool apparatus in the system, with the at least two prospector spool apparatus present on different respective flowlines, each associated with a respective wellhead. Each respective prospector spool apparatus may have a unique prospector molecule such that the presence of that unique marker may identify and help quantify flow from a particular well.

In one or more embodiments, each flowline that is associated with a wellhead includes two or more prospector spool apparatus arranged in series, in parallel, or both in series and in parallel.

For example, rather than providing a bypass, a second prospector spool apparatus may be installed in parallel, with appropriate valving, and placed in "standby" mode while the first prospector spool apparatus is operational. When the first prospector spool apparatus is depleted of prospector molecule, the second prospector spool apparatus may be placed in service while the first prospector spool apparatus is replaced.

As another example, serial prospector spool apparatus may be used on a single flowline from a wellhead, such as where a first prospector spool apparatus includes a prospector molecule having affinity for water, and a second prospector spool apparatus includes a prospector molecule having affinity for oil. In this manner, the oil and water that flows from each well may be quantified.

In one or more embodiments, a single prospector spool apparatus includes two or more prospector molecules, such as one having an affinity for water and the other for oil.

As the prospector spool apparatus releases the prospector molecule, the prospector spool apparatus becomes depleted of the prospector molecule. In other words, the porous layer in the apparatus loses prospector molecule during use. For example, the prospector molecule may be released into fluid and passed from the prospector spool apparatus. When the prospector spool apparatus is depleted of the prospector molecule, the apparatus may be replaced. In one or more embodiments, the prospector spool apparatus is modular. Meaning, a prospector spool apparatus may be removed from the system. When the prospector spool apparatus is removed from the system, this allows for repair, maintenance, refill of prospector molecule, or replacement of the apparatus. In some embodiments, for example, the porous media may be a cartridge that may be easily inserted and withdrawn from the housing. In other embodiments, for example, the porous media may be coated or installed within the housing, and may thus the modular spool may be replaced with another module (housing, porous media, and prospector molecule having similar connections and dimensions as the spool being replaced).

In addition, a bypass may be included in a system that allows fluid to pass around the prospector spool apparatus. In one or more embodiments, the bypass is one-way. The bypass prevents fluid flow into the prospector spool apparatus. Although the bypass in FIG. 1 is positioned fore and aft of the prospector spool apparatus, other suitable bypass configurations provide one-way fluid flow around the prospector spool apparatus. A bypass may advantageously allow for an operator to divert fluid flow through the prospector spool apparatus by activating a network of valves that blocks fluid flow at the inlet end and the outlet end of the prospector spool apparatus. In this way, the operator may seamlessly remove a prospector spool apparatus while fluid continues to flow through the respective bypass. Even without a bypass, an operator may activate a network of valves that blocks fluid flow at the inlet end and the outlet end of the prospector spool apparatus. Further, where a multiplicity of prospector spool apparatus are included in parallel in a flowline, a network of valves may be activated to block fluid flow in a prospector spool apparatus while fluid flow may continue through another prospector spool apparatus in parallel. This allows one prospector spool apparatus to be taken offline for service, repair, replenishment, or replacement, while the other prospector spool apparatus in parallel remains in place.

A multiplicity of prospector spool apparatus on a single flowline is not necessarily limited to a parallel configuration, for example, a series configuration may be used, or a combination of parallel and series configuration on a single flowline.

Such configurations allow for the system to have a different configuration of prospector spool apparatus on a flowline compared to the configuration of prospector spool apparatus on a different flowline. The operator may fit a prospector spool apparatus having one or more type of prospector molecule (having chemical affinity for gas, oil, or water) at different parts of a flowline, or on different flowlines.

In one example, a first prospector molecule having chemical affinity for oil is included in a first prospector spool apparatus in a flowline, a second prospector molecule having chemical affinity for gas is included in a second prospector spool apparatus in parallel (or in series) in the flowline, and a third prospector molecule having chemical affinity for water is included in a third prospector spool apparatus in parallel (or in series) in the flowline. In this example, each prospector spool apparatus may allow for detection and quantification of different fluid types from a single flowline associated with a wellbore, and for detection and quantification of these for multiple wells in a single measurement.

In another example, a first prospector molecule having chemical affinity for oil and a second prospector molecule having chemical affinity for gas is included in a first prospector spool apparatus in a flowline, and a third prospector molecule having chemical affinity for water is included in a second prospector spool apparatus in a flowline. In this example, two different prospector spool apparatus may allow for detection of different fluid types.

In another example, a first prospector molecule having chemical affinity for oil, a second prospector molecule having chemical affinity for gas, and third prospector molecule having chemical affinity for water are included in a prospector spool apparatus in a flowline. In this example, a single prospector spool apparatus may allow for detection of different fluid types.

In another example, prospector molecules in a prospector spool apparatus in a first flowline are uniquely identifiable from prospector molecules in a prospector spool apparatus in a second flowline. When the prospector molecules released in the fluid commingle to converge at a header, this advantageously allows for identification of multiple flowlines simultaneously.

Other combinations of prospector molecule types may be matched with different amounts and configurations of prospector spool apparatus in a system according to one or more embodiments. Advantageously, the chemical prospector system is not particularly limited in configuration so that it may meet the requirements of a variety of gas-oil separation plant feeds with a multiplicity of wells and wellheads. As a non-limiting example, in a water producing well there may be a need to include multiple prospector spool apparatus with a prospector molecule having chemical affinity for water.

Figure 4:
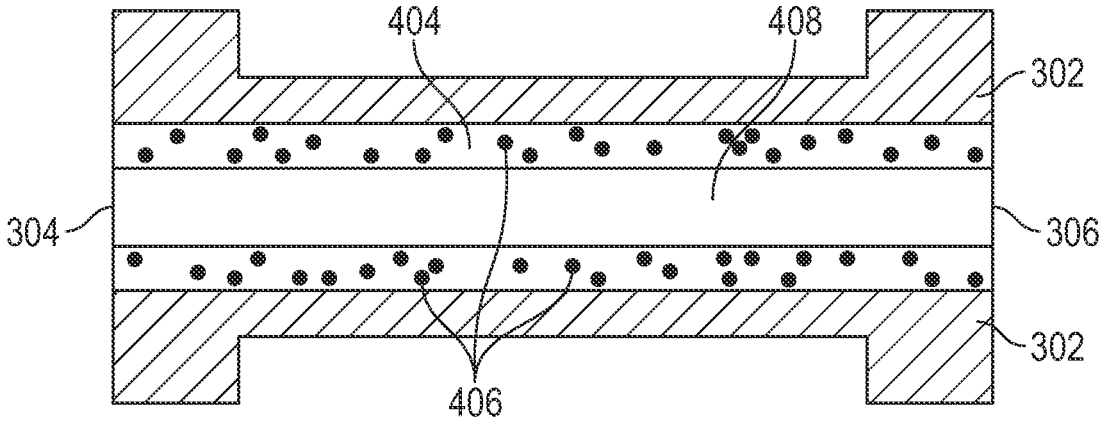
FIG. 4 shows a sectional view (side perspective) of the prospector spool apparatus, according to one or more embodiments.

FIG. 4 depicts a sectional view (side perspective) of the prospector spool apparatus, cross-sectioned along the central longitudinal axis of the housing. FIG. 4 shows the porous layer 404 positioned along the inner surface of the housing. As shown in FIG. 4, the porous layer may extend from the inlet 304 at the inlet end of the housing to the outlet 306 at the outlet end of the housing. The prospector molecule 406 is embedded in the porous layer. Flow channel 408 is positioned along the central longitudinal axis of the housing defining an inner surface of the porous layer. As shown in FIG. 4, the flow channel may be a void (empty space) when installed and prior to fluid flow through the flow channel.

Figure 5:
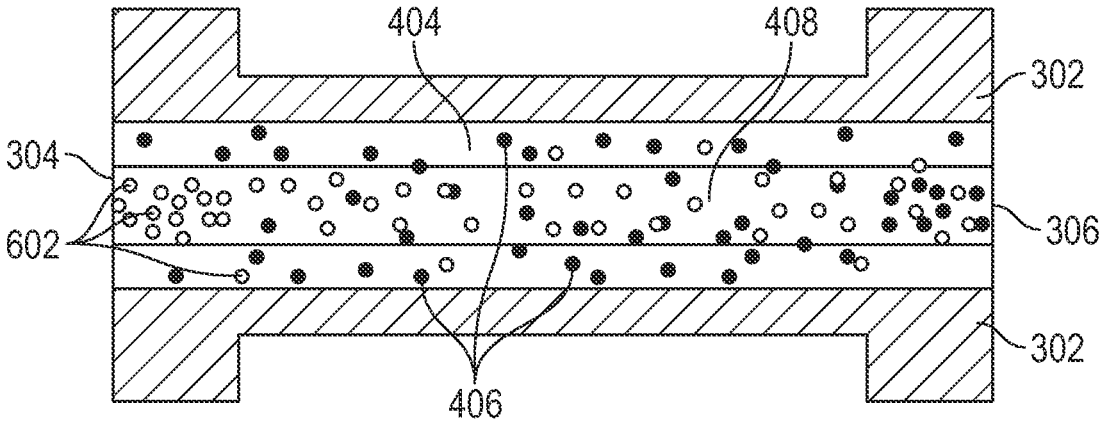
FIG. 5 shows a sectional view (side perspective) of the prospector spool apparatus with fluid flow, according to one or more embodiments.

FIG. 5 depicts a sectional view (side perspective) of the prospector spool apparatus with fluid flow. The prospector spool apparatus is shown cross-sectioned along the central longitudinal axis of the housing in FIG. 5. When a fluid 602 enters the housing of the prospector spool apparatus at the inlet end, the fluid flows through the flow channel 408. The fluid also flows through the porous layer 404. As fluid passes through the porous layer from the inlet end to the outlet end of the housing, it intermingles with the prospector molecule 406 that is embedded in the porous layer. A prospector molecule that has chemical affinity for the respective fluid may break free from the porous layer and enter the fluid. Fluid that contains the prospector molecule passes from the outlet end of the housing and exits the prospector spool apparatus, being carried downstream with the fluid flow.

As the fluid changes in chemical composition, temperature, or pressure, the prospector molecule may have greater or lesser chemical affinity for the fluid. Advantageously, the concentration of prospector molecule in the fluid correlates with the chemical composition of the fluid and properties of the fluid including, but not limited to flow rate, temperature, pressure, and other suitable parameters relating to chemical affinity. A greater chemical affinity between the prospector molecule and the fluid results in a greater concentration of prospector molecule within the fluid. Conversely, a lower chemical affinity between the prospector molecule and the fluid results in a lower concentration of prospector molecule within the fluid.

When combined with other advantages of the prospector molecule, including having specific chemical affinity for oil, water, or gas, and being uniquely identifiable, further advantages of the system may be present when more than one type of prospector molecule is included. As previously described, in one or more embodiments there may be one type of prospector molecule embedded in the porous layer. In one or more embodiments, there may be more than one type of prospector molecule embedded in the porous layer of the prospector spool apparatus. When a prospector molecule that has specific chemical affinity for oil and a prospector molecule that has specific affinity for gas are included, the different types of prospector molecule may break free from the porous layer at different rates according to the fluid composition. In other words, the rate at which the different types of prospector molecule break free from the porous layer is dependent upon the type of fluid that flows through the prospector spool apparatus (and other parameters related to chemical affinity as previously described). When different types of prospector molecule are present in the fluid, an individual type of prospector molecule relates to a flow rate, temperature, pressure, etc. of an individual fluid type. The chemical affinity of a specific type of prospector molecule may also extend to water and other fluids commonly present in a flowline. Thus, a prospector spool apparatus may be tailored with different types of the prospector molecule for identifying and quantifying a combination of different types of fluid, and for identifying and quantifying flows from multiple wells, using a single commingled sample of the combined flow from the numerous wells associated with the system.

A prospector molecule that has specific chemical affinity for oil includes, but is not limited to, a perfluorinated hydrocarbon. For example, perfluorinated hydrocarbons useful in embodiments herein may not have chemical affinity for gas or water. Examples of perfluorinated hydrocarbons that may be used include perfluorodimethylcyclobutane, perfluoromethylcyclopentane, and perfluoromethylcyclohexane, among others. Each of the numerous wells associated with the system may thus be provided a unique prospector molecule having affinity for oil, if desired, for example.

A prospector molecule that has specific chemical affinity for gas includes, but is not limited to, sulfur hexafluoride (SF6). For example, sulfur hexafluoride (SF6) may not have chemical affinity for oil or water. Other volatile molecules having an affinity for gas may also be used to thus provide a unique prospector molecule having affinity for gas, if desired, for example.

A prospector molecule that has specific chemical affinity for water includes, but is not limited to, fluorinated benzoic acids. For example, fluorinated benzoic acids may not have chemical affinity for gas or oil. Various fluorinated benzoic acids or other fluorinated acids may be used to provide each of the numerous wells associated with the system a unique prospector molecule having affinity for water, if desired, for example.

Turning to further system configurations, in one or more embodiments the system may run from multiple wells to a gas-oil separation plant. Gathering of fluid via two or more flowlines may be advantageous when there are numerous wells or when the wells are widely dispersed. Flowlines from individual wells converge on one or two sites where fluid from individual flowlines commingle. Such sites may be broadly referred to as satellites or gathering centers. The location of the sites may be chosen to minimize flowline length from the wellhead.

One of ordinary skill in the art would appreciate types of inlet feeds in a gas-oil separation plant that may include a manifold, a header, a trunkline, other suitable inlet feed components, or a combination thereof. The inlet feed is configured to pass fluid to a vessel, for example, a separator in the gas-oil separation plant. In some instances, a header (production header) may include or may be a manifold (production manifold). In one or more embodiments, the prospector spool apparatus is upstream of the header. The header may be an arrangement of valves and collector pipes that allows the flow from individual wells to be routed according to their pressure to the appropriate separator system (high pressure, intermediate pressure, low pressure, or test separator).

In one or more embodiments, a collection point is configured to collect a sample of the commingled fluid for the identifying and the quantifying. The two or more prospector apparatus are upstream of the header.

A chemical injection point may be included on a header or on individual header lines to enable the injection of chemicals including, but not limited to an inhibitor, a demulsifier, and other suitable chemicals for fluid treatment and testing before entering a gas-oil separation plant. Thus, fluid that is passed to the gas-oil separation plant may include other chemicals in addition to the fluid from a well and the associated prospector molecules. For example, injection of chemicals, such as a demulsifier, at the chemical injection point may ensure efficient separation of the oil and water before the separation process begins in the gas-oil separation plant.

As shown in FIG. 1, the trunkline and/or the vessel are the entry point to the gas-oil separation plant. The trunkline may have a collection point 14 configured to collect a sample of the commingled fluid from the numerous wellheads associated with the system. The vessel may be, for example, a test trap, a pressure vessel, a separator, or a combination thereof. The system may include one or more vessels. One of ordinary skill in the art would appreciate other suitable vessels that may be used in a gas-oil separation plant to receive feed from wells.

In one or more embodiments, the system includes a collection point for withdrawing a sample of a fluid comprising prospector molecules and fluids from the multiple flow lines. The system may include one or more collection point. The collected fluid may be used for analyses, such as identifying and quantifying the flow from each wellhead. The collection point is configured to withdraw a sample of the fluid. The withdrawn fluid may be collected by hand or may be routed automatically to a measurement apparatus 18. One or more collection point (or sample point) for this purpose may be included downstream of the prospector spool apparatus. Advantageously, a collection point may be at a position where two or more flowlines converge, or downstream thereof. This allows for sample collection from multiple wells simultaneously. Multiple collection points may be included in a system to analyze fluid flow from commingled fluid flow at various locations.

In one or more embodiments, a system includes a measurement apparatus 18 downstream of the prospector spool apparatus. The measurement apparatus 18 may be downstream of a collection point, such that a fluid sample may pass from the collection point to the measurement apparatus 18. The measurement apparatus 18 includes a sensing device 20. The sensing device 20 may be, for example, a flow meter, a compositional analyzer, an optical probe, a pressure transmitter, a temperature transmitter, and combinations thereof. The sensing device 20 detects a specific prospector molecule (or a property of the specific prospector molecule) in the fluid. The sensing device 20 may detect multiple types of prospector molecules in a fluid, such as in a commingled fluid. Quantitative and qualitative properties that may be measured by the measurement apparatus 18 include flow rate (gross flow rate), concentration of prospector molecule, water cut percentage, gas oil ratio (GOR), fluid velocity, and combinations thereof. The measurement apparatus 18 may include a computer control device configured for receiving output of the measurement apparatus 18 and for breaking out individual fluid properties (flow rate, etc.) and characteristics of the individual fluids in a commingled fluid flow. The computer control device may be useful for analyzing the quantitative and qualitative properties of the fluid from the well.

The following example demonstrates how individual well (flowline) fluid flow rates and overall commingled fluid flow rates are determined; this example may be used as an outline for other individual fluid properties. Because individual flows from multiple wells each contain a unique prospector molecule (or combination of prospector molecules), the measurement apparatus can identify flow properties of an individual well from a commingled fluid. When considering a property such as flow rate, a sensing device will detect a prospector molecule in the fluid flow compared to the overall fluid flow. The sensing device will also detect another, different prospector molecule in the fluid flow compared to the overall fluid flow. Detections are passed downstream as signals (such as electrical signals) where they are received at the measurement apparatus. Thus, the analyzing may include a step of detecting.

In the flow rate measurement example, the measurement apparatus is calibrated to determine a flow rate range of each prospector molecule compared to an overall fluid flow. Calibration allows the measurement apparatus to associate a signal input (fluid flow of a prospector molecule) when the overall fluid flow is in a particular range. The calibration is performed across various fluid flow ranges. Thus, the analyzing process may include calibrating.

When the measurement apparatus receives prospector molecule detection signals during use, the real-time signal is compared to the calibrated set of known flow rate values at the computer control device. The computer control device measures the real-time signals by comparing the signals to the calibrated values and breaking apart (deconvoluting) the signals to provide meaningful flow rate data for the operator. Thus, the analyzing process may include receiving a signal associated with the first prospector molecule and with the second prospector molecule, and deconvoluting the signals to provide data associated with the first fluid, the second fluid, and the commingled fluid.

Further, analyzing the commingled fluid may include measuring the first prospector molecule and the second prospector molecule in the sampled commingled fluid and, based on the measurement of the first prospector molecule, determining a property of the first fluid, and based on the measurement of the second prospector molecule, determining a property of the second fluid, and based on the measurement of the first and the second prospector molecule, determining a property of the overall fluid.

In this way, the operator may view data output (measurements) that includes individual and unique prospector molecule fluid flow data and associated fluid flow data of the individual flowline (from an individual well). Data from individual contributions to fluid flow can be combined by the measurement device, so the operator may view individual flowline (and well) flow rate and combined flowline (and well) flow rate data. The operator may advantageously view one, two, or more (if equipped) flowline (well) flow rates in any particular combination compared to overall flow rate. Thus, overall fluid flow of the commingled fluid and individual flow line (well) fluid flow can be determined, without for example a direct measurement as with a conventional flow meter.

The previous example is not limited to flow rate (gross flow rate), and may be also used with measurement apparatus that may measure concentration of prospector molecule, water cut percentage, gas oil ratio (GOR), fluid velocity, and combinations thereof.

In one or more embodiments, the system includes a safety device in addition to the prospector spool apparatus (and bypass if present). For example, a safety device may include but is not limited to a check valve (non-return valve) to prevent backflow or leakage, a pressure relief valve to discharge automatically, an emergency shutdown valve to automatically block the flow of fluids, a pressure indicator for routine operational checks, bleed valves, or other suitable safety devices, and combinations thereof may be included.

A method for identifying and quantifying a fluid in an oil-gas separation plant conduit comprises providing a system according to one or more embodiments. The method may include producing a fluid from a well. When the fluid passes through a wellhead, the method may include producing the fluid from the wellhead.

In one or more embodiments, the method includes flowing fluid through a prospector spool apparatus. When the fluid intermingles with the prospector molecule, the respective prospector molecule breaks free from the porous layer in the prospector spool apparatus and diffuses into the fluid. The fluid passes from the prospector spool apparatus into the flowline and flows toward the gas-oil separation plant.

In one or more embodiments, the method includes collecting a sample of the fluid at a collection point and analyzing the quantitative and qualitative properties of the fluid from the well. A fluid sample that is collected at the collection point may be analyzed for presence of the prospector molecule to characterize flows based on measurements from the measurement apparatus and computer control device. Measurements may include quantitative and qualitative analysis. In this way, a well may be identified as producing oil, water, gas, or a combination thereof. Further, a well may be identified as a low production or a no production well in the absence of detected prospector molecule for a particular fluid.

The method may include producing a fluid from a system comprising two or more wellheads according to one or more embodiments. Thus, the method may comprise commingling of fluids from two or more wellheads in the header. In such embodiments, collecting a sample of the fluid includes collecting a commingled fluid sample. The method may include analyzing the quantitative and qualitative properties of the commingled fluid.

In one or more embodiments, the method includes planning remedial actions regarding a well with low or no production based on measurement results or trends in the measurement results that include quantitative and qualitative analysis.

In another one or more embodiments, the method includes removing the prospector spool apparatus from the system. For example, the method may include activating the bypass. When the bypass is activated (such as via valves or block offs), fluid is diverted through the bypass and does not enter the prospector spool apparatus. Thus, the method may include directing the fluid around the prospector spool apparatus. Once removed, the prospector spool apparatus may be maintained, cleaned, repaired, or replaced.

One or more embodiments of the present disclosure may provide at least one of the following advantages.

One or more embodiments of the system or method provides improved flow rate measurement and data analysis over conventional systems and methods. Thus, production optimization of a variety of wells connected to a network of flowlines and trunklines may be improved over conventional approaches compared to one or more embodiments of systems and methods herein.

One or more embodiments of the present disclosure overcome measurement error and uncertainty of conventional instruments for gas-oil separation plants. Specifically, one or more embodiments of the present disclosure relies on a prospector molecule that has chemical affinity for a respective fluid. The prospector molecule may be detected downstream of the prospector spool apparatus, resulting in improved measurement and less uncertainty compared to conventional instruments.

Measurement affectations that are present in conventional instruments include, but are not limited to: viscosity and density of fluid in a flowline that affects measurements; vents upstream of test instruments that cause swirling; incorrect design of straighteners; inadequate pipe lengths upstream of test instruments and separators; pulsating flow; vibrations; and other known causes of measurement affectations. Without wanting to be bound by theory, one or more embodiments of the system and method herein overcomes measurement affectations compared to conventional instruments.

Additionally, operator errors are less frequent with one or more embodiments of the present disclosure. One or more embodiments of the system and method herein include measurement apparatus that detects a prospector molecule. Thus, the prospector molecule may be positively identified. Meaning, one or more embodiments of the present disclosure relies merely on the presence of the prospector molecule in the fluid flow, leading to less frequent operator errors. On the other hand, conventional instrument systems for gas-oil separation plants may introduce measurement error or uncertainty. Conventional systems may rely heavily on programming of a flow computer set by an operator. Uncertainty and error in measurement in conventional systems can be introduced by an operator may choose the wrong calculation model, selecting the incorrect correction tables for liquid and gas properties, and the calibrations themselves may be incorrect. Without wanting to be bound by theory, one or more embodiments of the system and method herein overcomes measurement error and uncertainty compared to conventional systems.

In one or more embodiments, the system provides both quantitative and qualitative rate measurement for fluids that are produced without commonly utilized means of rate measurements. Commonly utilized means of rate measurements include but are not limited to a flow meter such as a Coriolis, ultrasonic, turbine, or differential flow meter. Commonly utilized means of rate measurements are used in routine activity of conventional well testing. When field operational issues occur with a wellhead, flowline, manifold, header, trunkline, or other parts of a gas-oil separation plant systems, conventional rate measurements may not comply with requirements during such instances. Meaning, conventional flow meters cannot be used or may need to be reset or recalibrated during or after field operational issues for compliance. One or more embodiments of systems and methods overcome the current operational challenges without hindering well testing compliance. Further, well testing may continue for one or more wells connected to a network of flowlines even during field operational issues when one or more embodiments of systems or methods are used.

In one or more embodiments, a single commingled sample that is collected from the system will advantageously provide information related to the production from each well in a network. Thus, systems and methods described herein save time and cost compared to conventional systems and methods that require sampling and analysis of flow from each individual well.

One or more embodiments of the present disclosure advantageously provide a means of troubleshooting when a manifold or a header is malfunctioning. For example, a sample downstream of a malfunctioning header (production manifold) may be collected to determine whether an individual well is found to be contributing to the source of the malfunction.

Advantageously, a well without production (low production or no production) may be immediately identified when using one or more embodiments of the system and method. Thus, related action may be implemented in a timely manner to bring a well without production back on stream, resulting in optimized and improved production.

Advantageously, a system with a prospector spool apparatus according to one or more embodiments does not decrease the life cycle of the well. In one or more embodiments, systems and methods described herein do not impact related facilities or other conventional testing systems that may be included in a gas-oil separation plant.

Accordingly, one or more embodiments of the present disclosure improves well testing performance, and overcomes limitations of testing capabilities associated with conventional systems and methods while providing flow rate data for gas-oil production plant operations.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for identifying and quantifying a fluid in a gas-oil separation plant conduit, comprising:

a first wellhead and a second wellhead;

a first flowline coupled to and downstream of the first wellhead and a second flowline coupled to and downstream of the second wellhead;

a first prospector spool apparatus coupled to the first flowline and downstream of the first wellhead and a second prospector spool apparatus coupled to the second flowline and downstream of the second wellhead, the first prospector spool apparatus and the second prospector spool apparatus each comprising:

a housing including an inlet end and an outlet end;

an inlet coupled to the housing and positioned at the inlet end;

an outlet coupled to the housing and positioned at the outlet end;

a porous layer comprising a polymer media and a prospector molecule embedded therein, the porous layer being positioned within the housing between the inlet end and the outlet end, an inner surface of the porous layer defining a flow channel therethrough configured to allow fluid flow;

wherein the prospector molecule has a chemical affinity for fluid selected from the group consisting of oil, gas, and water, and is configured to diffuse into the fluid flow; and wherein the prospector molecule of the first prospector apparatus is different than the prospector molecule of the second prospector apparatus;

a header coupled to and downstream of the first flowline and the second flowline configured to receive and commingle fluid from each of the first and second prospector spool apparatus outlets;

a collection point downstream of the header configured to collect a sample of the commingled fluid.

2. The system of claim 1, further comprising a trunkline downstream of the header and wherein the collection point is disposed on the trunkline.

3. The system of claim 1, further comprising a vessel selected from the group consisting of a test trap, a pressure vessel, a separator, and a combination thereof downstream of the collection point.

4. The system of claim 1, further comprising a measurement apparatus configured to provide quantitative and qualitative analysis of the flows from each of the first wellhead and the second wellhead from the sample.

5. The system of claim 1, further comprising a bypass coupled to the first flowline configured to pass the fluid around the first prospector spool apparatus and to block the fluid from entering the first prospector spool apparatus.

6. The system of claim 1, further comprising a bypass coupled to the second flowline configured to pass the fluid around the second prospector spool apparatus and to block the fluid from entering the second prospector spool apparatus.

7. The system of claim 1, wherein the housing includes material selected from the group consisting of carbon steel, stainless steel, aluminum, polyvinyl chloride, polyethylene, nickel, chromium, and combinations thereof.

8. The system of claim 1, wherein the polymer media is selected from the group consisting of benzoxazine, polyepoxide, and combinations thereof.

9. The system of claim 1, wherein the prospector molecule is selected from the group consisting of fluorinated benzoic acids, perfluorinated hydrocarbons, sulfur hexafluoride (SF6), and combinations thereof.

10. A method for identifying and quantifying a fluid in a gas-oil separation plant conduit comprising:

providing a system, comprising:

a first wellhead and a second wellhead;

a first flowline coupled to and downstream of the first wellhead and a second flowline coupled to and downstream of the second wellhead;

a first prospector spool apparatus coupled to the first flowline and downstream of the first wellhead and a second prospector spool apparatus coupled to the second flowline and downstream of the second wellhead, the first prospector spool apparatus and the second prospector spool apparatus each comprising:

a housing including an inlet end and an outlet end;

an inlet coupled to the housing and positioned at the inlet end;

an outlet coupled to the housing and positioned at the outlet end;

a porous layer comprising a polymer media and a prospector molecule embedded therein, the porous layer being positioned within the housing between the inlet end and the outlet end, an inner surface of the porous layer defining a flow channel therethrough configured to allow fluid flow;

wherein the prospector molecule has a chemical affinity for fluid selected from the group consisting of oil, gas, and water, and is configured to diffuse into the fluid flow; and wherein the prospector molecule of the first prospector apparatus is a first prospector molecule and the prospector molecule of the second prospector apparatus is a second prospector molecule, and the first prospector molecule is different than the second prospector molecule;

a header coupled to and downstream of the first flowline and the second flowline configured to receive and commingle fluid from each of the first and second prospector spool apparatus outlets;

a collection point downstream of the header configured to collect a sample of a commingled fluid;

producing a first fluid from a first well coupled to the first wellhead and a second fluid from a second well coupled to the second wellhead;

flowing the first fluid through the first prospector spool apparatus and the second fluid through the second prospector spool apparatus;

allowing the first fluid and the second fluid to commingle to produce the commingled fluid;

collecting a sample of the commingled fluid at a collection point; and analyzing the commingled fluid to provide a quantitative and qualitative analysis of the first fluid and the second fluid based on the sampled commingled fluid.

11. The method of claim 10, wherein the analyzing the commingled fluid comprises:

detecting the first prospector molecule and the second prospector molecule in the commingled fluid thereby producing a signal associated with the first prospector molecule and the second prospector molecule.

12. The method of claim 11, wherein the detecting occurs with a sensing device in a measurement apparatus, the sensing device selected from the group consisting of a flow meter, a compositional analyzer, an optical probe, a pressure transmitter, a temperature transmitter, and a combination thereof.

13. The method of claim 12, wherein the analyzing the commingled fluid comprises detecting the first prospector molecule and the second prospector molecule in the sampled commingled fluid using the sensing device and, based on a detected amount of the first prospector molecule, determining using the measurement apparatus, a property of the first fluid, and based on a detected amount of the second prospector molecule, determining using the measurement apparatus, a property of the second fluid, and based on a detected amount of the first and the second prospector molecule, determining using the measurement apparatus, a property of the commingled fluid.

14. The method of claim 10, wherein the analyzing the commingled fluid comprises:

receiving a signal associated with the first prospector molecule and with the second prospector molecule, and deconvoluting the signals to provide data associated with the first fluid, the second fluid, and the commingled fluid.

15. The method of claim 14, wherein the receiving and deconvoluting occurs with a measurement apparatus comprising a computer control device.

16. The method of claim 10, further comprising determining one or more property of the first fluid and one or more property the second fluid.

17. The method of claim 16, wherein the property is selected from the group consisting of gross flow rate, concentration of prospector molecule, water cut percentage, gas oil ratio (GOR), fluid velocity, and a combination thereof.

* * * * *